United States Patent [19]

Hanson

[11] 4,317,295

[45] Mar. 2, 1982

[54] WEAR RESISTING MEMBER FOR ARTICLE OF FOOTWEAR

[75] Inventor: Chris A. Hanson, Boulder, Colo.

[73] Assignee: Hanson Industries Incorporated, Boulder, Colo.

[21] Appl. No.: 130,196

[22] Filed: Mar. 13, 1980

[51] Int. Cl.[3] ..... A43B 5/04; A43B 21/24; A43B 13/22

[52] U.S. Cl. ..... 36/117; 36/39; 36/75 R

[58] Field of Search ..... 36/39, 73, 75, 71.5, 36/117

[56] References Cited

U.S. PATENT DOCUMENTS

| | | | |
|---|---|---|---|
| 2,628,439 | 2/1953 | Rochlin | 36/39 |
| 3,237,321 | 3/1966 | McKinley | 36/39 |
| 3,852,898 | 12/1974 | Rubens | 36/73 |
| 4,146,980 | 4/1979 | Cross | 36/39 |

*Primary Examiner*—Patrick D. Lawson
*Attorney, Agent, or Firm*—Merriam, Marshall & Bicknell

[57] ABSTRACT

A wear resisting member or pad is mounted in the undersurface of the heel of an article of footwear, such as a ski boot, to improve the wearability of the heel. When employed in a ski boot, the heel thereof is formed with a cavity for weight reduction, and an opening is provided in the bottom wall of the heel for receiving the pad. When mounted in the opening in the heel, an upstanding boss on the pad engages a depending boss on the underside of an inclined wall in the heel so that the pad strengthens the heel and supports the heel of the wearer's foot. The pad is releasably retained in the opening in the heel by a plurality of circumferentially spaced lugs on the margin of the opening and a groove in the outer periphery of the pad into which the lugs extend. The pad is shiftable to different rotated positions in the opening to compensate for wear and can be replaced when worn out.

10 Claims, 6 Drawing Figures

WEAR RESISTING MEMBER FOR ARTICLE OF FOOTWEAR

BACKGROUND OF THE INVENTION

This invention relates to footwear, and more particularly relates to a replaceable wear resisting member for the undersurface of the heel of a ski boot.

Many ski boots presently and heretofore available utilize an outer shell of substantially rigid plastic material, and an inner liner of flexible, softer material to provide support and comfort to the wearer. While the outer, plastic shells of such boots are usually capable of resisting the wear and abrasion imposed thereon by the associated ski bindings, the outer plastic shell of such boots do not possess sufficient strength or anti-abrasion characteristics to resist the wear which occurs when the skier is out of his bindings and walking on rough surfaces, such as concrete sidewalks, gravel paths and the like.

Accordingly, it is a general object of the present invention to provide a novel article of footwear having improved wear characteristics.

A more particular object is to provide a novel ski boot of the type utilizing a substantially rigid, outer plastic shell in which a wear resisting member is provided in the heel section of the sole portion of the boot to improve the wear characteristics thereof.

A further object is to provide a novel ski boot of the foregoing character, in which the wear resisting member closes an opening in the bottom wall of the hollow heel section of the boot so that the weight of the boot is reduced without loss of strength or wear resistance.

A specific object is to provide a novel ski boot of the foregoing character, in which the wear resisting member can be shifted to different positions in its mounting to compensate for wear or can be easily replaced when necessary.

BRIEF SUMMARY OF THE INVENTION

Briefly described, in its broader aspects, the present invention contemplates a wear resistant member or pad which is mounted in a recess in the undersurface of the heel of an article of footwear to improve the wearability thereof. In its more specific aspects, the present invention contemplates a wear resistant pad which is shiftably and removably mounted in an opening in the bottom wall of the heel of a ski boot to improve the wearability of the boot when the skier is out of his bindings and walking on rough surfaces, such as concrete sidewalks, gravel paths, or the like. The wear resisting pad has an upstanding boss which engages a depending boss on an upper wall in the heel of the boot. The upper wall supports the wearer's heel and strengthens the heel of the boot.

The wear resisting pad is mounted in an opening in the bottom wall of the heel, such opening communicating with a cavity in the heel. The cavity is defined in part by the spaced bottom and upper walls of the heel and serves to lighten the boot. A plurality of circumferentially spaced lugs are provided around the margin of the opening for extension into a groove in the outer periphery of the wear resisting pad to releasably retain the pad in the opening. The undersurface of the pad is provided with a plurality of recesses to improve the footing of the wearer of the boot when he is out of his bindings.

DETAILED DESCRIPTION

Figure 1:
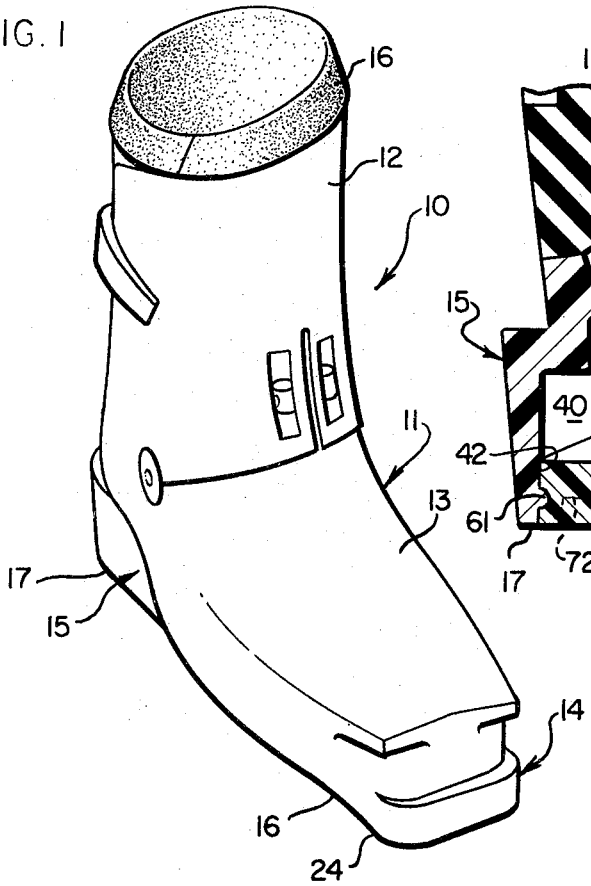
FIG. 1 is a perspective view of a ski boot having an outer shell of substantially rigid, plastic and employing a replaceable wear resisting member in the undersurface of the heel, the wear resisting member embodying the features of the present invention.

In FIG. 1 an article of footwear, specifically a ski boot, is illustrated and indicated generally at 10. The boot 10 includes an outer shell, indicated at 11, which is preferably of a substantially rigid plastic material. The shell includes an upper, ankle engaging portion 12, a lower, foot engaging portion 13, a sole portion, indicated generally at 14, and a heel 15. The boot 10 also includes a liner 16, which is of softer material than the shell 11 and which improves the fit of the boot and the wearer's comfort. The boot 10 is similar in many of its structural aspects to the boots disclosed in U.S. Pat. Nos. 3,798,799 and 3,882,561 to Alden B. Hanson and Chris A. Hanson, respectively. Reference should therefore be made to these patents, which are assigned to the assignee of this application, for a better understanding of the general construction of the boot 10.

Figure 3:
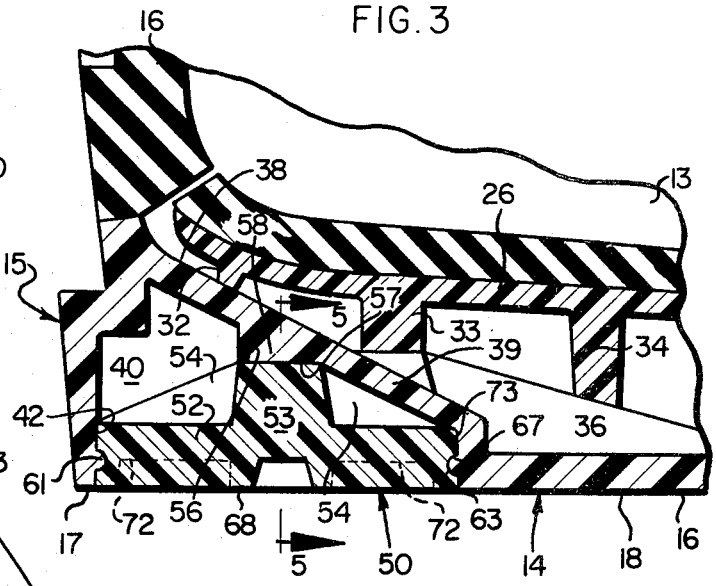
FIG. 3 is an enlarged, longitudinal sectional view, taken along the line 3—3 of FIG. 2.
Figure 2:
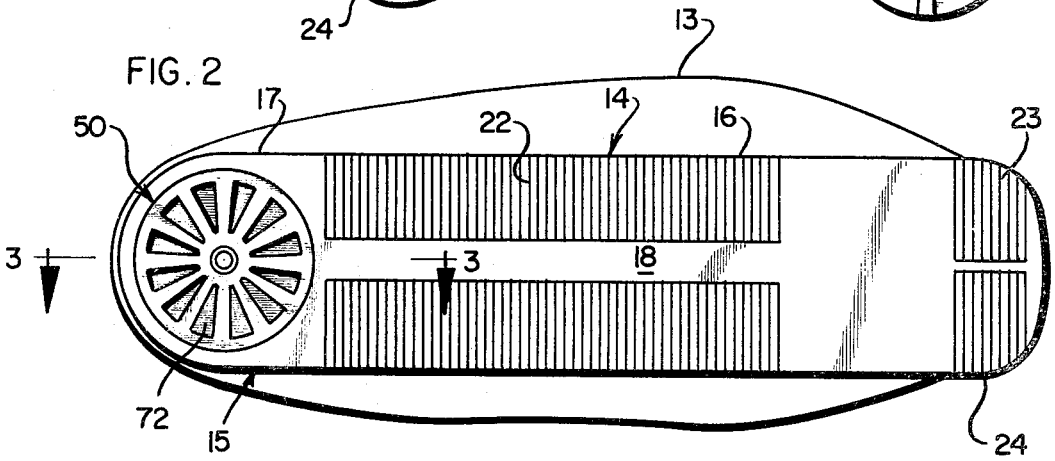
FIG. 2 is a bottom plan view of the underside of the sole portion of the ski boot illustrated in FIG. 1 and showing one exemplary location of the wear resisting member of the present invention.

Referring now to FIGS. 2 and 3 in conjunction with FIG. 1, it will be seen that the sole portion 14 of the boot 10 includes a section 16, which underlies the sole portion of the wearer's foot, and a section 17, which underlies the heel 15 of the boot and the heel of the wearer's foot. As will be apparent from FIG. 2, the sections 16 and 17 are integral with the sole portion 14 in order to provide a substantially flat undersurface, indicated at 18, for engaging the flat upper surface (not shown) of the binding (also not shown) of an associated ski. Transversely extending grooves or serrations 22 may be provided in the undersurface 18 of the sole portion 14, and a similar set of grooves or transverse serrations 23 may be provided in the toe section 24 to improve the wearer's footing when he is out of his bindings and walking on hard packed snow or other slippery surfaces.

Referring now to FIG. 3, it will be seen that an inner sole or bed 26 is provided in the foot engaging portion 13 of the boot, the bed 26 being contoured to fit the arch of a wearer's foot. The bed 26 is maintained in spaced relation above the sole portion 14 by a plurality of depending ribs, three of which are shown in FIG. 3 and indicated at 32, 33 and 34, respectively. The upper surface of the bed 26 slopes downwardly toward the toe section 24 so that the skier can maintain the desired forward lean position in comfort while skiing. The lower ends of the ribs 33 and 34 engage upstanding bosses or ribs on the upper surface, indicated at 36, of the sole portion 14. The rear rib 32 engages the slanting upper surface, indicated at 38, of an upper wall, indicated at 39, in the heel 15 of the boot. The wall 39 defines a cavity 40 in the heel 15 which opens in the undersurface 18 of the heel section 17. Such opening or recess in the undersurface 18 of the heel section 17 is indicated at 42. According to the present invention, a wear resisting member or pad, embodying the features of the present invention and indicated generally at 50, is movably and releasably retained in the opening 42.

Figure 6:
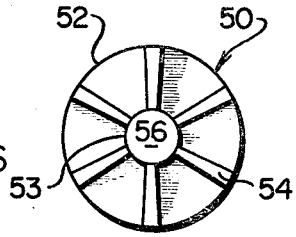
FIG. 6 is a top plan view of the wear resisting member of the present invention.
Figure 4:
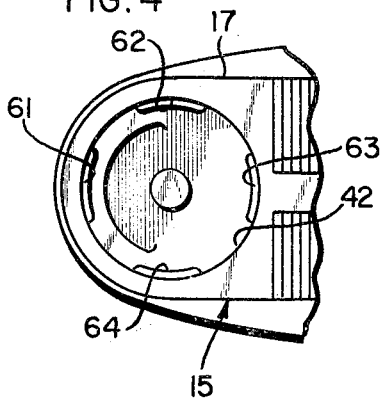
FIG. 4 is a fragmentary, bottom plan view of the heel section of the sole portion of the boot illustrated in FIG. 2 and showing some of the internal details of the cavity in which the wear resisting member of the present invention is mounted.
Figure 5:
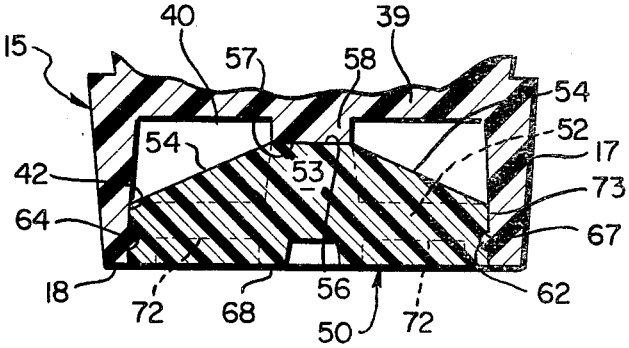
FIG. 5 is a fragmentary vertical sectional view taken along the line 5—5 of FIG. 3.

Referring now to FIGS. 4, 5 and 6 in conjunction with FIG. 3, it will be seen that the pad 50 generally comprises a disk-like body portion 52 having a boss or hub portion 53 which extends upwardly from the central portion of the body portion 52. A plurality of strengthening ribs 54 radiate outwardly from boss 53 and interconnect the boss with the body portion 52. The upper surface, indicated at 56, of the boss 53 is flat and engages a flat surface 57 on the under or lower side of a bearing boss 58 formed integrally with the upper wall 39. Thus, when mounted in the opening 42, with the boss 53 thereof engaging the boss 58, the pad 50 provides support for the heel of the wearer's foot and also serves to strengthen the heel 15 of the boot 10.

According to the present invention means is provided for movably and releasably retaining the pad 50 in its mounting opening 42. Such means preferably comprises lug means including at least one, and preferably a plurality of circumferentially spaced lugs 61, 62, 63 and 64, formed in the vertically extending, cylindrical wall or margin of the opening or recess 42, and a circumferentially extending groove 67 in the outer periphery of the body portion 52 of the pad 50. The groove 67 is sized to snugly receive the lugs 61–64 when the latter is fully seated in the opening 42 with the upper surface 56 of the central boss 53 engaging the undersurface 57 of the bearing boss 58, as shown in FIG. 5. When so positioned, the flat undersurface, indicated at 68, of the pad 50 is substantially coplanar or flush with the undersurface 18 of the sole portion 14 and heel section 17 of the boot 10.

In order to improve the skier's footing when he is out of his bindings, the undersurface 68 of the pad 50 may be provided with a plurality of indentations or recesses 72. Such recesses, in the present instance, are preferably pie-shaped and are circumferentially spaced in the undersurface 68. It will be understood, however, that the recesses 72 could be of a different configuration than that illustrated in FIG. 2.

While the pad 50 will, under most circumstances be retained in the opening 42 when the lugs 61–64 are seated in the annular groove 67 in the pad, supplemental fastening means could be used to further secure the pad in the opening. Thus, the central boss or hub 53 of the pad 50 could be provided with an upwardly extending hole to receive a screw (not shown) threaded into the bearing boss 58. Such construction is thus contemplated by the present invention.

Removal of the pad 50 from the cavity 40 may be effected in any convenient manner, such as by inserting the blade of a small screwdriver between the cylindrical side wall, indicated at 73, of the pad and the margin or wall of the opening 42 and prying the pad outwardly. Slots (not shown) could be provided in the lower surface 18 of the heel section 17 for this purpose. In addition, one or more holes could be provided in the inclined upper wall 39 of the heel 15 of the boot to permit an instrument to be inserted through these holes and into engagement with the pad 50, thereby permitting the pad 50 to be pushed out of the opening 42. The provision of such holes is also within the contemplation of the present invention.

Since the greatest amount of wear on the heel section 17 occurs toward the rear end thereof, the pad 50 may be periodically moved to a different position in its opening 42 to compensate for this wear condition. Since the pad 50, in the present instance, is circular in cross section, it may be conveniently rotated to different positions, relative to the sole portion 14, as wear develops on a particular area thereof by engaging an appropriate tool in one or more of the recesses 72 and applying sufficient torque to effect rotation of the pad. Any other suitable instrument could be employed for this purpose.

It will be understood that the wear resisting member or pad 50 of the present invention could be made of the same material as the outer shell 11 of the boot 10, or of a different and more wear resistant material.

It should also be understood that the wear resisting member or pad 50 could be of a cross sectional configuration other than circular, i.e. noncircular. If the pad were noncircular, the opening in the undersurface 18 of the heel section 17 would be of the same shape and it would be necessary to remove the pad from the opening in order to change its position to effect the aforementioned wear compensation adjustment.

While only one embodiment of the invention has been herein illustrated and described, it will be understood that modifications and variations thereof may be developed which do not depart from the spirit of the invention and the scope of the appended claims.

I claim:

1. In an article of footwear having a sole portion having a cavity therein, said portion also having a bottom wall having an undersurface adapted to engage a support surface, the improvement of a wear resisting member carried by said bottom wall for reducing wear on the undersurface of said portion when the wearer of said footwear is walking on a rough or other abrasive surface;

said bottom wall of said portion having an opening therein, and said wear resisting member being shiftably mounted in said opening; and, said cavity being defined in part by an upper wall spaced above said bottom wall, said upper wall serving to support at least part of said wearer's foot, and said wear resisting member extending upwardly through said cavity and engaging said upper wall.

2. The footwear of claim 1 wherein said portion comprises the heel of said footwear.

3. The footwear of claim 1 wherein said article of footwear is a ski boot.

4. The footwear of claim 1, in which an upstanding boss is provided on said wear resisting member for engaging said upper wall.

5. The footwear of claim 4, in which a bearing boss depends from the underside of said upper wall, said bearing boss has a lower end, and the upper end of said upstanding boss on said wear resisting member engages the lower end of said bearing boss on said upper wall.

6. The footwear of claim 5, in which said upper wall slopes downwardly from the rear end of said heel toward the front end of said footwear.

7. The footwear of claim 5, in which said wear resisting member includes a disk-like body portion having upper and lower surfaces, said upstanding boss extends upwardly from the upper surface of said body portion, and a plurality of strengthening ribs extend between said upstanding boss and the upper surface of said body portion.

8. The footwear of claim 1, in which retaining means is provided for releasably retaining said wear resisting member in said opening.

9. The footwear of claim 8, in which said releasable retaining means comprises a groove in said wear resisting member and lug means on the margin of said opening, said lug means retaining said wear resisting member in said opening when seated in said groove.

10. The ski boot of claim 1, in which said wear resisting member is shiftable to different positions relative to said portion to compensate for wear.

* * * * *